United States Patent [19]

Blaker et al.

[11] Patent Number: 4,655,111

[45] Date of Patent: Apr. 7, 1987

[54] FIBER CUTTING DEVICE

[75] Inventors: James G. Blaker, Des Moines; Joseph F. Statsney, Indianola, both of Iowa

[73] Assignee: Cemen Tech, Inc., Indianola, Iowa

[21] Appl. No.: 764,488

[22] Filed: Aug. 12, 1985

[51] Int. Cl.[4] ..... B26D 5/20

[52] U.S. Cl. ..... 83/356.3; 83/436; 83/420; 83/580; 83/913

[58] Field of Search ..... 83/356.3, 355, 420, 83/356, 356.1, 356.2, 436, 444, 913, 446, 447, 440, 440.1, 580; 226/168, 196, 198; 72/250

[56] References Cited

U.S. PATENT DOCUMENTS

| | | | |
|---|---|---|---|
| 3,143,766 | 4/1961 | Rohn | 425/313 |
| 3,333,298 | 12/1964 | List et al. | 83/167 X |
| 3,543,984 | 12/1970 | Mansfield | 226/196 |
| 3,735,661 | 5/1973 | Eichler et al. | 83/675 |
| 3,812,749 | 5/1974 | Lowen et al. | 83/436 X |
| 3,828,996 | 8/1974 | Warren | 226/198 X |
| 3,986,417 | 10/1976 | Anderson et al. | 83/356.3 X |
| 4,044,640 | 8/1977 | Gokyu | 83/42 |
| 4,176,568 | 12/1979 | Nilsson | 226/196 X |
| 4,377,098 | 3/1983 | Bardenhagen et al. | 83/310 |
| 4,398,438 | 8/1983 | Bryan et al. | 83/310 |
| 4,398,439 | 8/1983 | Seragnoli | 83/356.3 |
| 4,428,217 | 1/1984 | Yanazawa et al. | 72/250 |
| 4,522,579 | 6/1985 | Rotondo et al. | 83/580 X |

*Primary Examiner*—James M. Meister
*Assistant Examiner*—John L. Knoble
*Attorney, Agent, or Firm*—Zarley, McKee, Thomte, Voorhees & Sease

[57] ABSTRACT

The fiber cutting device of the present invention comprises a die block having a feed opening extending therethrough for receiving a multi-strand fiber. The die block has a flat cutting surface at one end of the feed opening. A fiber feeder is adapted to feed the fiber through the feed opening toward the cutting surface. A rotatable cutting blade is mounted to rotate about an axis approximately parallel to the longitudinal axis of the feed opening, and the blade has a cutting edge adapted to pass in sliding frictional engagement with the cutting surface of the die block once during each revolution of the cutting blade so as to cooperate with the cutting surface to cut the fiber exiting from the feed opening. Adjustable controls are provided for adjusting the speed at which the feeder feeds the fiber through the feed opening, and additional adjustable controls are provided for adjusting the rotational speed of the cutting blade.

11 Claims, 9 Drawing Figures

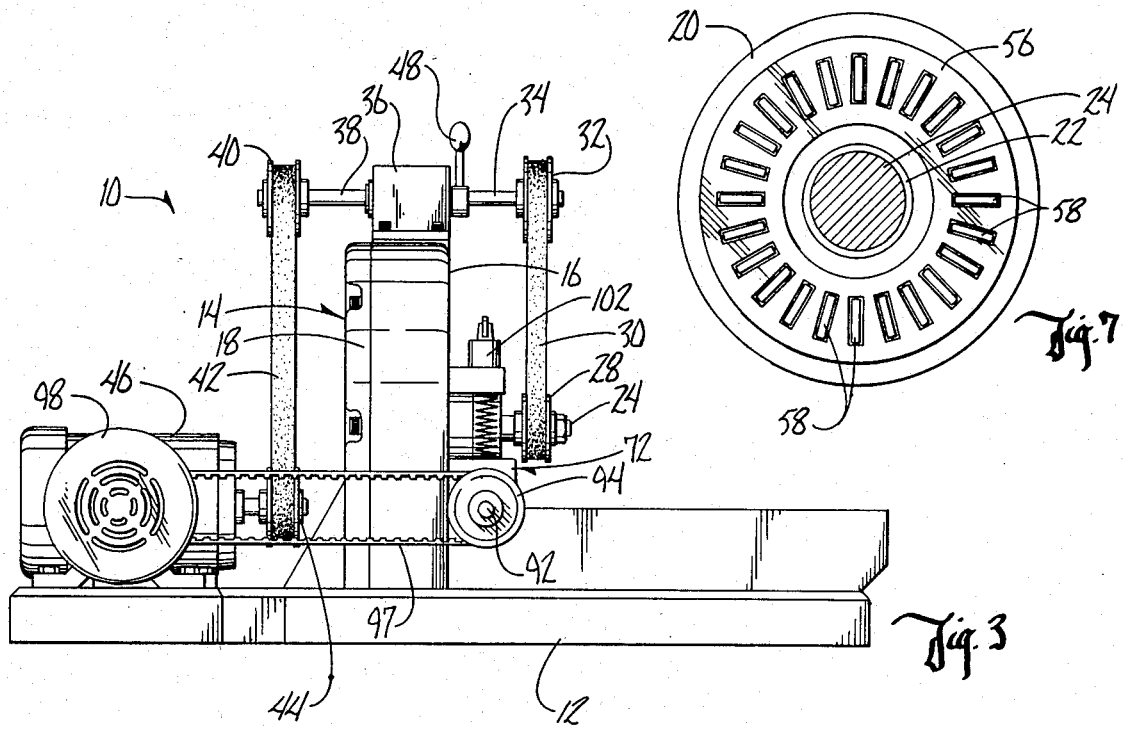
Fig. 3
Fig. 7
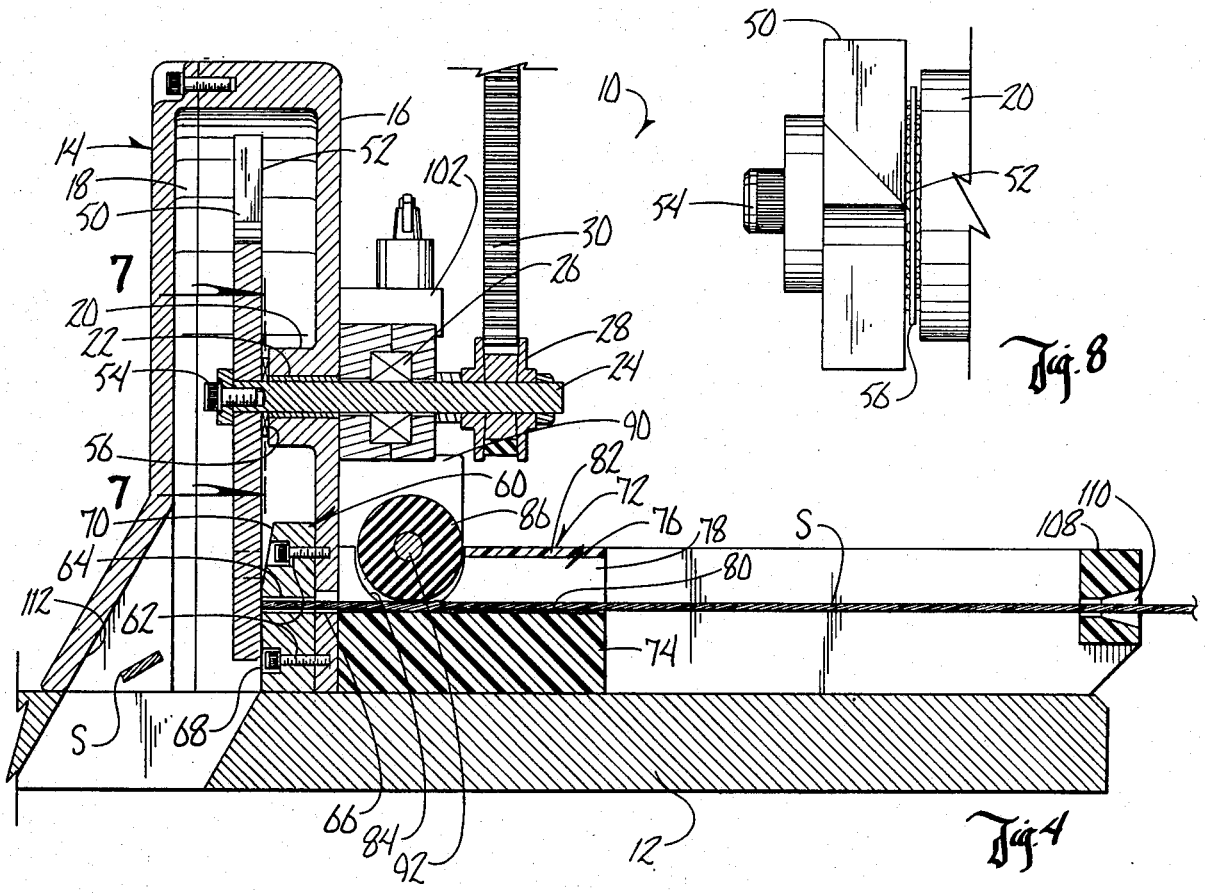
Fig. 4
Fig. 8

FIBER CUTTING DEVICE

BACKGROUND OF THE INVENTION

This invention relates to a fiber cutting device, and particularly to a device for cutting fibers for use in reinforcing concrete mixes.

Plastic fiber materials are sometimes used as additives to concrete mix to provide reinforcement and strength to the concrete. An example of such a fiber material is shown in FIG. 1A. It includes an elongated multi-strand fiber which can be spread apart into a net configuration such as shown at N of FIG. 1A. The fiber is originally produced in elongated strands S which must be cut into segments at the desired length. When the segments are mixed into the concrete, they spread apart into the net configuration such as at N, and provide reinforcement to the concrete.

The fiber material is very strong and is difficult to cut, particularly in view of the fact that there are many strands in the webbed net. Therefore, a quick and efficient means is needed for cutting these elongated fiber strands into segments so that the segments can be used and mixed with concrete.

Therefore, a primary object of the present invention is the provision of an improved fiber cutting device.

A further object of the present invention is the provision of an improved fiber cutting device which is small and light in weight so that it can be transported to construction sites where concrete is being mixed and poured.

A further object of the present invention is the provision of a device which permits the fiber strands to be cut quickly in a continuous process so that a large number of strand segments can be cut in a short period of time.

A furher object of the present invention is the provision of a fiber cutting device which may be adjusted so as to maximize the efficiency with which the fibers are cut.

A further object of the present invention is the provision of a fiber cutting device which can cut a plurality of strands of fibers at once.

A further object of the present invention is the provision of a fiber cutting device which minimizes the wear on the cutting blade.

A further object of the present invention is the provision of a fiber cutting device having a feed means which is reliable and which is adjustable to adjust the speed at which the fibers are fed through the cutting device.

A further object of the present invention is the provision of a fiber cutting device which permits adjustment of the speed of the cutting blade as well as the speed at which the fibers are fed so as to achieve the desired length of fiber segments which are being cut.

A further object of the present invention is the provision of a device which is economical to manufacture, durable in use and efficient in operation.

SUMMARY OF THE INVENTION

The present invention utilizes a die block having a feed opening extending therethrough. The fiber is fed through the feed opening and is chopped off by a rotating cutting blade as the fiber exits from the feed opening in the die block.

A feeding apparatus is provided for feeding the fiber into the feed opening of the die block. This feeding apparatus comprises a slide block having a semi-cylindrical surface therein. An elongated slot is provided in the slide block and includes a bottom surface which is tangential to the arcuate cylindrical surface. A rubber feed roller is rotatably mounted within the arcuate surface and is in frictional engagement with the bottom slide surface of the groove. The fibers are fed into the groove and underneath the feed roller where they are compressed between the feed roller and the slide surface. The feed roller is rotated, and the rotation of the feed roller causes the fiber to continue to slide longitudinally along the slide surface, into the feed opening of the die block, and outwardly where the fiber is chopped off by the cutting blade.

The feed roller is preferably made from a rubber-like material which has a relatively high coefficient of friction on its outer surface. The slide block, on the other hand, and particularly the slide surface within the slide block, is made of a plastic material having a much lower coefficient of friction than the surface of the feed roller. Thus, when the fiber is compressed between the feed roller and the slide surface, it tends to slide longitudinally in response to rotation of the feed roller.

The feed roller is mounted within bearing means which are vertically adjustable so as to adjust the pressure between the feed roller and the slide surface. Furthermore, the rotational speed of the feed roller is adjustable so as to adjust the speed at which the fibers are fed to the cutting blade. A further adjustment means is provided for adjusting the rotational speed of the cutting blade. Thus, the length of the fibers can be adjusted by varying the speed of the cutting blade and also by varying the speed at which the fibers are fed to the cutting blade.

The fiber cutting device of the present invention utilizes a plurality of grooves in the slide block so that a plurality of strands of fibers can be fed simultaneously to the cutting blade. Similarly, a plurality of feed openings are provided in the die block and are aligned with the grooves in the slide block so that each time the cutting blade rotates, it cuts all of the fibers as they are exiting from the plurality of feed openings.

BRIEF DESCRIPTION OF THE DRAWINGS

FIG. 3 is a side elevational view of the present invention.

FIG. 4 is a sectional view of the present invention as taken along line 4—4 of FIG. 2.

FIG. 7 is a sectional view taken along line 7—7 of FIG. 4.

FIG. 8 is an enlarged detail view of the cutting blade and its mounting.

DETAILED DESCRIPTION OF THE PREFERRED EMBODIMENT

Figure 1:
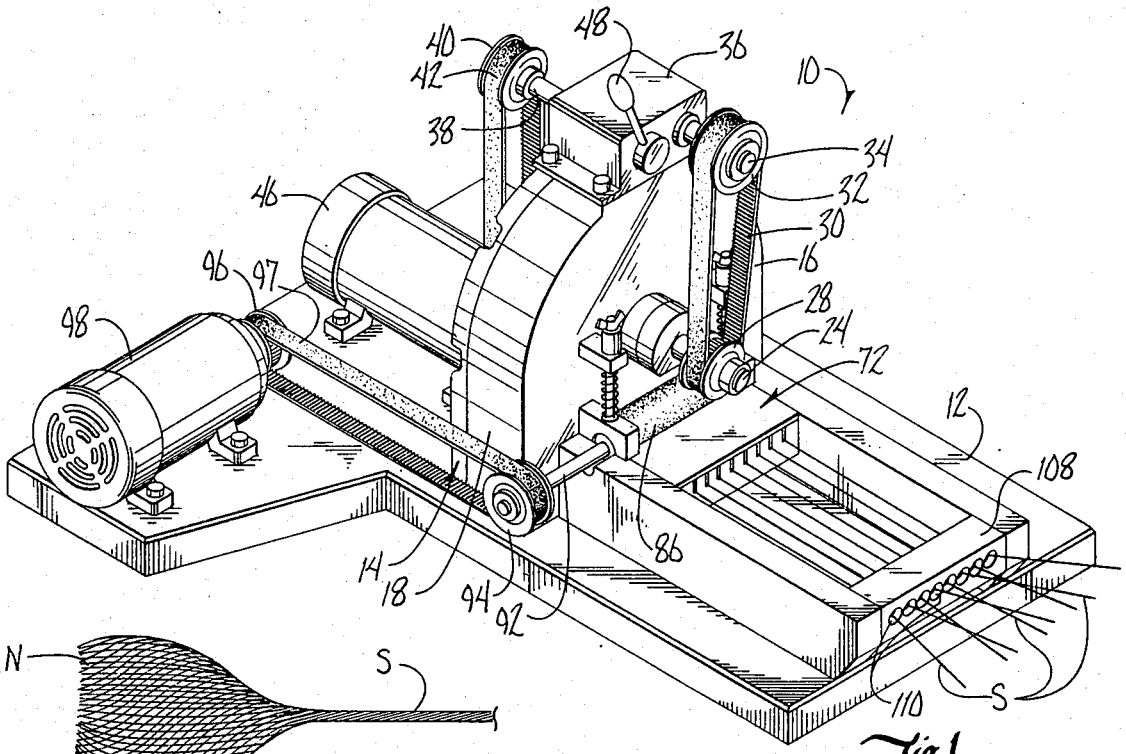
FIG. 1 is a pictorial view of the present invention.
Figure 1A:
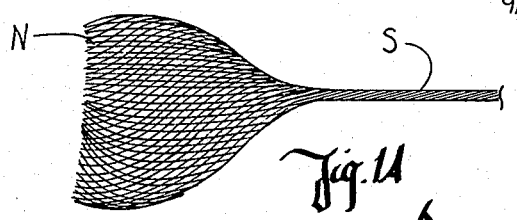
FIG. 1A is a view showing the structure of the fibers which are being cut.
Figure 2:
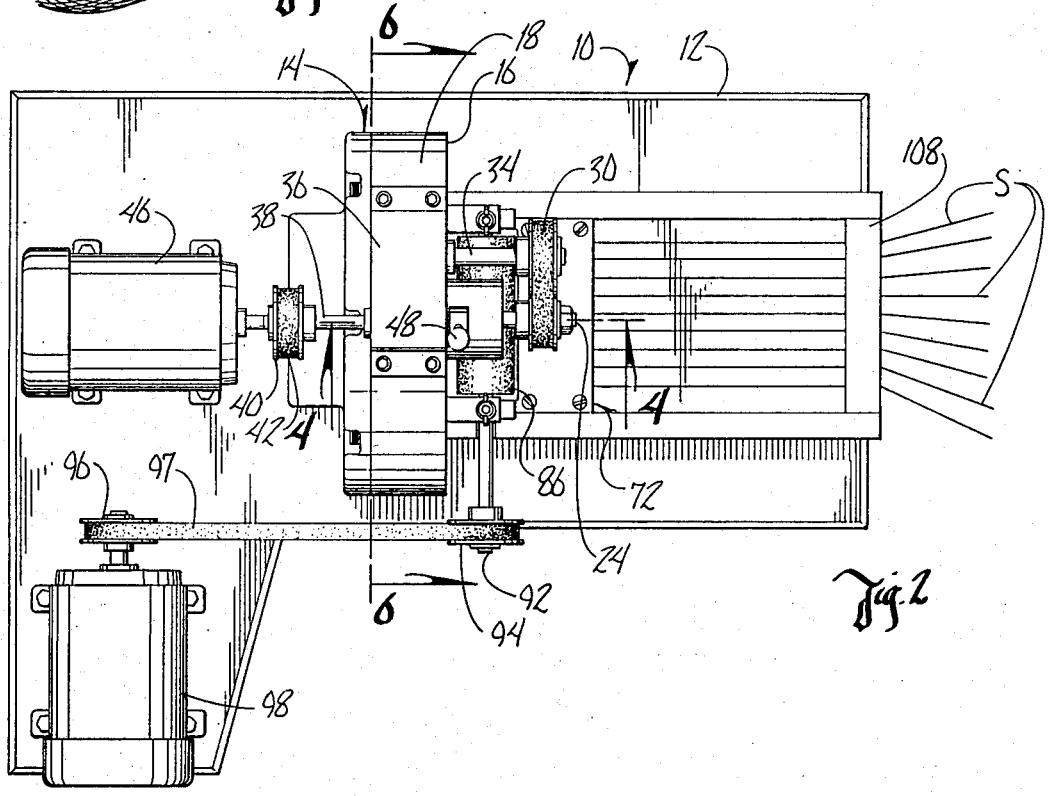
FIG. 2 is a top plan view of the present invention.
Figure 5:
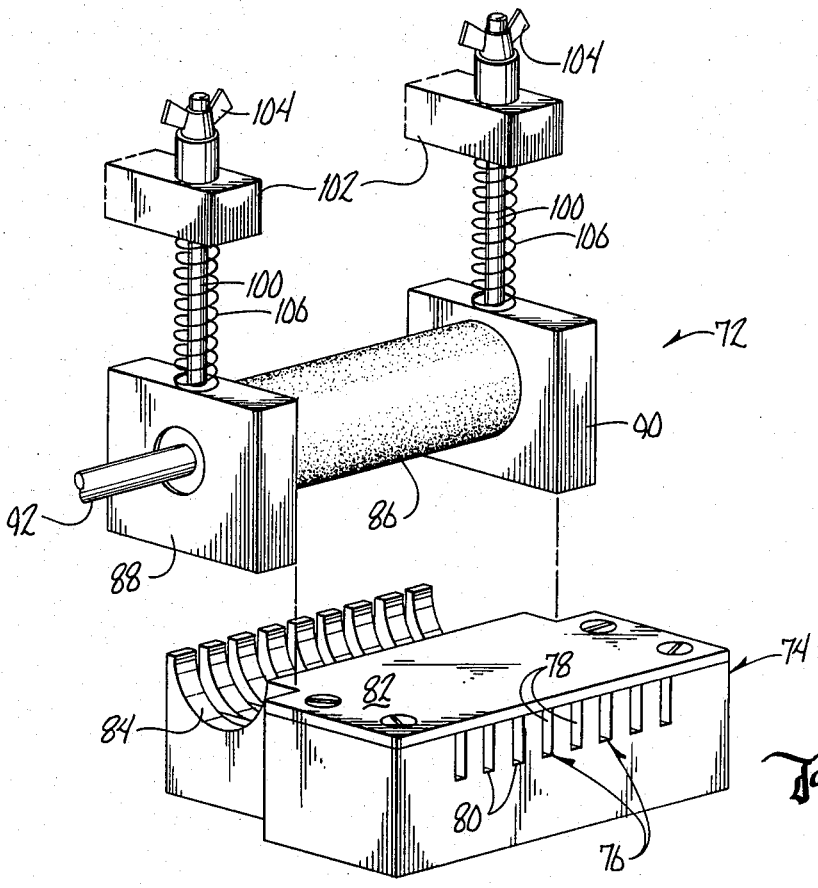
FIG. 5 is an exploded perspective view of the feed apparatus of the present invention.

Referring to the drawings, the numeral 10 generally refers to the cutting device of the present invention. Device 10 is adapted to be mounted on a support surface 12. Rigidly mounted to support surface 12 is a central frame 14 having a vertical wall 16 and an annular flange 18. Centrally located within vertical wall 16 is a circular bearing mount 20 having an aperture extending therethrough and including a bushing 22 therein. Rotatably extending through bushing 22 is a rotatable shaft 24 which is supported by bearings 26. One end of shaft 24 has a pulley 28 affixed thereto for receiving a drive belt 30. Drive belt 30 is also trained around a second pulley 32 which is affixed to the output shaft 34 from a bear box 36. Gear box 36 has an input shaft 38 provided with a pulley 40 around which is trained a belt 42. Belt 42 is trained around the drive pulley 44 mounted on the output shaft of a motor 46.

Gear box 36 includes a shifting lever 48 which permits the speed of shaft 24 to be adjusted from a zero rotational velocity up to any of a plurality of different velocities.

Mounted on the opposite end of shaft 24 from pulley 28 is a cutting blade 50. Blade 50 includes a pair of sharp cutting edges 52 at its outer ends, and is fixed to shaft 24 by means of bolt 54. A thrust bearing assembly 56 is interposed between cutting blade 50 and the axial end of bearing mount 20 so as to insure a smooth rotation of blade 50 and further so as to limit the axial movement of blade 50 during rotation. Bearing assembly 56 is shown in detail in FIGS. 7 and 8 and includes a plurality of small roller bearings 58 inserted in a circular array therein so as to permit thrust bearing 56 to rotate between blade 50 and the axial end of bearing mount 20.

Figure 6:
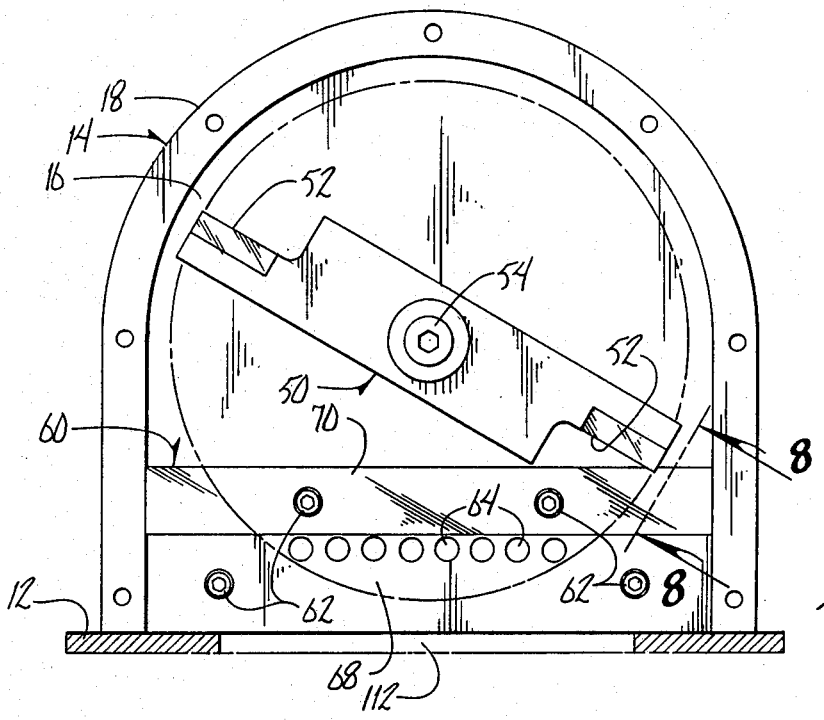
FIG. 6 is a sectional view taken along line 6—6 of FIG. 2.

Referring to FIGS. 4 and 6, a die block 60 is secured to the lower end of vertical wall 16 of central frame 14 by means of recessed bolts 62. Die block 60 includes a feed opening 64 extending therethrough, and feed opening 64 is aligned with a similar opening 66 in central frame 14. Die block 60 also includes a cutting surface 68 and a slightly tapered surface 70 which are on the outlet end of feed opening 64.

As can be seen in FIG. 4, the cutting edge 52 of blade 50 is adapted to slide in frictional engagement with the cutting surface 68 of die block 60, thereby permitting it to cut off a fiber strand S which is being fed through the feed opening 64. The tapered surface 70 minimizes the friction between blade 50 and the die block 60 so that the friction is limited to the time when the tips of the blade 50 pass by the feed aperture 64. As can be seen in FIG. 6, a plurality of feed apertures 64 are provided in die block 60, and the number of these feed openings may be varied as desired.

A feed device generally designated by the numeral 72 is mounted on the opposite side of vertical wall 16 from die block 60. Feed device 72 comprises a feed block 74 having a plurality of elongated horizontal grooves 76 provided therethrough. Each groove 76 includes side walls 78 and a bottom wall 80. Bottom wall 80 provides a slide surface along which the fiber strand S may move prior to entering feed eperture 64 of die block 60. A cover plate 82 is attached over the tops of grooves 76 so as to prevent the fibers from coming out of the grooves 76 during operation.

Adjacent the forward ends of grooves 76 is a transverse semi-cylindrical surface 84 which extends transversely of the plurality of grooves 76. Surface 84 is approximately tangential to the bottom wall 80 of the grooves 76.

Matingly fitted within cylindrical surface 84 is a cylindrical feed roll 86 which is preferably constructed of a material which has a higher coefficient of friction than the coefficient of friction of the material of which feed block 74 is constructed. Preferably roller 86 is constructed of a rubber material, whereas it is preferable that the feed block 74 be constructed of a plastic material such as urethane.

Roller 86 is rotatably mounted within a pair of bearing blocks 88, 90 and includes a shaft 92 extending outwardly therefrom. A pulley 94 is fixed to the end of shaft 92 and a belt 97 is trained around pulley 94 and the drive pulley 96 of a variable speed motor 98.

Extending upwardly from bearing block 88 are a pair of rods 100 which extend through a pair of stationary mounts 102 for vertical sliding movement therein. Mounts 102 are rigidly secured to vertical wall 16 of central frame 14. Threaded over the ends of rods 100 are wing nuts 104 which limit the downward movement of rods 100. A pair of springs 106 are yieldably compressed between stationary mounts 102 and bearing blocks 88 so as to urge bearing blocks 88 downwardly until their downward movement is limited by a wing nut 104. The downward vertical position of bearing blocks 88 may be adjusted by threading wing nuts 104 upwardly or downwardly.

As seen in FIG. 4, the roller 86 is matingly fitted within semi-circular surface 84, and compresses the strand S against the bottom wall 80 of the grooves 76. When roller 86 is rotated, the friction between roller 86 and fiber strand S causes the strand to move axially toward the feed opening 64. The low coefficient of the feed block 74 facilitates this movement.

A guide block 108 is provided adjacent the intake ends of grooves 76, and includes a plurality of guide openings 110 for receiving the various strands S of fiber material.

In operation, the cutting blade 50 is rotated by actuating motor 46 and by moving lever 48 into a position which engages the gears in gear box 36. The various fiber strands S are fed through guide openings 110 and through grooves 76 beneath roller 86 and into feed opening 64. Then motor 98 is actuated so as to cause rotation of feed roller 86. The use of a variable speed motor 98 is preferable because the rotational speed of roller 86 may be varied to achieve the desired length of strand segments which are ultimately cut. The rotation of roller 86 causes the strand S to be moved axially through feed opening 64. With each revolution of blade 50, the strands S are cut off as cutting edge 52 passes by cutting surface 68 of die block 60. By increasing the speed of roller 86, it is possible to increase the length of the strands which are cut with each revolution of blade 76 because the strands S move further axially before they are cut. The cut strands drop by gravity through a feed chute 112 where they can be collected for use in mixing with concrete.

Several features of the present invention are important to insure the proper cutting of the fibers. The ability to control the speed at which the fibers are fed to opening 64 is important so as to keep the fibers at the desired length when they are cut. The relative coefficients of friction between roller 86 and of the bottom wall 80 of grooves 76 are also important to insure that the fibers continue moving in a continuous and even manner.

The tapered surface 70 of die block 60 is also important to the present invention in that it minimizes the friction between the cutting edges 52 and the die block 60. Cutting edges 52 only frictionally engage the die block 60 when they are adjacent the feed openings 64, thereby minimizing the wear which occurs to the cutting edges 52. The thrust bearing 56 also provides an important advantage to applicant's invention in that it maintains the cutting blade 50 in a fixed axial position so as to insure close tolerance between the cutting edges 52 and the cutting surface 54.

The length of the strands being cut can also be varied by varying the velocity at which blade 50 is rotated. This is accomplished by changing the gear arrangement in gear box 36 by means of lever 48.

The device is small, and can be transported to construction sites where concrete is being mixed and poured. It is easy to operate and can be operated at very high velocities to cut a large number of fibers for use in mixing and pouring concrete.

Thus it can be seen that the device accomplishes at least all of its stated objectives.

What is claimed is:

1. A device for cutting an elongated multi-strand fiber into a plurality of segments, said device comprising:

a die block having a feed opening extending therethrough along a feed opening axis for receiving said multi-strand fiber, said die block having a flat cutting surface at one end of said feed opening;

feed means for feeding said fiber through said feed opening toward said cutting surface;

a rotatable cutting blade mounted to rotate about an axis substantially parallel to said feed opening axis of said feed opening, said blade having a cutting edge adapted to pass in sliding frictional engagement with said cutting surface of said die block once during each revolution of said cutting blade so as to cooperate with said cutting surface to cut said fiber exiting from said feed opening;

said feed means comprising a cylindrical roller and a slide block;

said slide block having at least one elongated horizontal groove extending therethrough, said groove having a longitudinal groove axis, a first end adjacent said feed opening and a second end, said groove having an elongated bottom wall forming a slide surface adapted to receive said fiber for longitudinal sliding movement within said groove toward said feed opening;

said slide block further including an arcuate indentation located between said first and second ends of said groove and having an arcuate surface with an axis of curvature extending transversely to said groove axis, said slide surface being approximately tangential to said arcuate surface at a pressure point located between said first and second ends of said groove;

said roller having a roller axis and an outer cylindrical surface, said roller being rotatably mounted about said roller axis and being positioned within said arcuate indentation with said cylindrical surface in close proximity to said slide surface at said pressure point so as to hold said fiber in frictional engagement

2. A device according to claim 1 and further comprising first control means connected between said drive means and said roller for adjusting the rotational speed of said roller and thereby adjusting the longitudinal speed at which said fiber moves through said feed opening.

3. A device according to claim 2 and further comprising second control means connected between said drive means and said rotatable cutting blade for adjusting the rotational speed of said cutting blade.

4. A device according to claim 1 wherein said slide surface has a lower coefficient of friction than the surface of said roller.

5. A device according to claim 1 comprising bearing means rotatably supporting said roller, said bearing means being movably mounted with respect to said slide block for vertical movement toward and away from said slide surface.

6. A device according to claim 5 comprising adjustment means for selectively adjusting the vertical position of said bearing means with respect to said slide surface so as to permit changes in the pressure exerted on said fiber between said roller and said slide surface.

7. A device according to claim 4 wherein said slide block is comprised of urethane plastic and said roller is comprised of rubber.

8. A device according to claim 1 wherein said groove axis is approximately perpendicular to said roller axis.

9. A device for cutting an elongated multi-strand fiber into a plurality of segments, said device comprising:

a die block having a feed opening extending therethrough for receiving said multi-strand fiber, said feed opening having a horizontal feed opening axis and inlet and outlet ends, said die block having a flat cutting surface surrounding said outlet end of said feed opening;

a cutting blade rotatably mounted about a blade axis substantially perpendicular to said flat cutting surface, said blade having a cutting edge which moves in a circular path during rotation of said blade, said cutting edge moving into frictional engagement with said cutting surface of said die during at least a portion of said circular path so as to cooperate with said cutting surface to cut said fiber exiting from said outlet end of said feed opening;

feed means for feeding said fiber to said inlet end of said feed opening and for moving said fiber through said feed opening and outwardly from said outlet opening of said feed opening;

said feed means comprising a rotatable roller and a slide block;

said slide block having at least one elongated groove extending therethrough and having first and second opposite ends, said first end being positioned adjacent said inlet end of said feed opening, said groove having a bottom wall and a pair of opposite sidewalls for guiding said fiber longitudinally through said groove, said slide block having an upwardly presented indentation therein, said indentation being located between said opposite ends of said groove and protruding downwardly through said sidewalls of said groove, said roller being positioned in said indentation and being rotatable about a roller axis which extends transversely with respect to the longitudinal axis of said groove, said roller having an outer cylindrical surface positioned in close proximity to said bottom wall of said groove at a point intermediate said first and second opposite ends of said groove for holding said fiber between said roller and said bottom wall, power means drivingly connected to said roller for rotating said roller about said roller axis whereby said roller causes said fiber to slide along said bottom wall and through said inlet opening where said cutting edge of said blade cuts said fiber.

10. A device according to claim 9 wherein a cover plate is attached to said slide block in covering relation over at least a portion of said groove so as to limit upward movement of said fiber within said groove.

11. A device according to claim 9 wherein a plurality of said feed openings are provided through said die block and a plurality of said grooves are provided in said slide block, said indentation protruding downwardly through said sidewalls of all said grooves and said outer cylindrical surface of said roller being in close proximity to all of said bottom walls of all of said grooves, said first ends of grooves each being adjacent one of said plurality of feed openings.

* * * * *